US010213066B2

(12) United States Patent
Weisang et al.

(10) Patent No.: US 10,213,066 B2
(45) Date of Patent: Feb. 26, 2019

(54) CORELESS ROLL OF ABSORBENT SHEET AND METHOD FOR MANUFACTURING THE SAME

(71) Applicant: SCA TISSUE FRANCE, Saint-Ouen (FR)

(72) Inventors: Nicolas Weisang, Colmar (FR); Donald Barredo, Ingersheim (FR)

(73) Assignee: ESSITY OPERATIONS FRANCE, Saint-Ouen (FR)

( * ) Notice: Subject to any disclaimer, the term of this patent is extended or adjusted under 35 U.S.C. 154(b) by 192 days.

(21) Appl. No.: 15/088,171

(22) Filed: Apr. 1, 2016

(65) Prior Publication Data

US 2017/0280946 A1 Oct. 5, 2017

(51) Int. Cl.

| | |
|---|---|
| ***A47K 10/16*** | (2006.01) |
| ***A47K 10/32*** | (2006.01) |
| ***B65H 19/28*** | (2006.01) |

(52) U.S. Cl.

CPC ..... *A47K 10/16* (2013.01); *B65H 19/286* (2013.01); *A47K 2010/3206* (2013.01); *B65H 2701/1924* (2013.01)

(58) Field of Classification Search

CPC ..... A47K 10/16; A47K 2010/3206; B65H 19/286; B65H 2701/1924

USPC ..... 428/500

See application file for complete search history.

(56) References Cited

U.S. PATENT DOCUMENTS

| | | | | |
|---|---|---|---|---|
| 2011/0079671 | A1 | 4/2011 | Wojcik et al. | |
| 2013/0011671 | A1* | 1/2013 | Fujita | C09J 105/00 428/355 CP |
| 2014/0084102 | A1* | 3/2014 | Techlin | B65H 19/2292 242/520 |

FOREIGN PATENT DOCUMENTS

| | | | |
|---|---|---|---|
| WO | WO-95/13183 | A1 | 5/1995 |
| WO | WO-2009/027874 | A1 | 3/2009 |
| WO | WO-2011/126707 | A2 | 10/2011 |

OTHER PUBLICATIONS

Derwent Abstract, week 201108, London: Derwent Publications Ltd., AN 2005-678902, JP 2005261736 A, (Jujo Kimberly KK), abstract.*

PerkinElmer, Inc., Waltham, MA, USA, online @www.perkinelmer.comCopyright © 2007-2011, pp. 1-2.*

International Search Report and Written Opinion dated Dec. 8, 2016 issued in corresponding international application No. PCT/IB2016/000595.

* cited by examiner

*Primary Examiner* — Daniel S Metzmaier

(74) *Attorney, Agent, or Firm* — Drinker Biddle & Reath LLP

(57) ABSTRACT

A coreless roll of an absorbent sheet product, such as napkins, toilet paper, towels etc., including a spirally wound continuous web of absorbent material having a first end and a second end and a coating composition comprising a specific polymer coated onto the second end is disclosed. The coreless roll has excellent resistance to collapsing, as well as excellent flexibility and elasticity. Moreover, the coreless roll has excellent disintegrability in water and can be used along its whole length. Also disclosed is a process for the manufacture of the coreless roll.

19 Claims, 5 Drawing Sheets

CORELESS ROLL OF ABSORBENT SHEET AND METHOD FOR MANUFACTURING THE SAME

TECHNICAL FIELD

The present disclosure relates to a coreless roll of an absorbent sheet product such as napkins, toilet paper, towels etc. In an aspect, the coreless roll is provided in a compressed form. The present disclosure also pertains to a process for the manufacture of the coreless roll.

BACKGROUND

Absorbent sheet products in rolled form find extensive use in modern society. Rolls of toilet paper, towels such as household (kitchen) towels or hand towels etc. are staple items of commerce.

Rolls of absorbent sheet product for home use (e.g. toilet paper) typically consist of a continuous web of absorbent material that is spirally wound around a prefabricated core made of a stiff material such as cardboard or glued paper. The core defines an axial hollow passageway, which is centrally positioned relative to the roll and extends from one edge of the roll to the other edge. The axial hollow passageway enables the consumer to easily mount the roll on the spindle of a roll holder. However, the core is expensive, requires storage space and additional manual handling. Furthermore, the core remains after use of the absorbent sheet product, thus increasing the risk of clogging sewage systems.

To address these concerns, "coreless" rolls and rolls with water-soluble cores have been developed. Among the most important properties of these products are their resistance to collapsing and their flexibility/elasticity.

"Collapsing" refers to the phenomenon occurring when the absorbent sheet product constituting the first inner turns of the roll (i.e. the turns forming the axial hollow passageway at winding start) cannot be stably maintained such that an axial hollow passageway is clearly defined.

Coreless rolls are generally associated with an increased risk of "collapsing". Collapsing typically occurs in the manufacture process of coreless rolls when the temporary core is extracted after completing the winding, or during storage and transport of the finished product. As a consequence of collapsing, it may become difficult to mount the roll on the spindle of a roll holder. Furthermore, collapsing generally creates a feeling of decreased product quality among consumers.

A "flexible" roll offers the benefit that it can be provided in a compressed form, which requires less space during storage and transport. As a result, storage and transport costs can be significantly reduced. The roll can be returned from its compressed (oval) form to the uncompressed (cylindrical) form by applying pressure along the longer diameter of the compressed (oval) form, i.e. perpendicular to the axis of the roll.

However, the absorbent sheet product constituting the first inner roll turns must be stably maintained when the roll is returned from the compressed form to the uncompressed form. That is, the axial hollow passageway must open itself and be clearly defined when the roll is returned to the cylindrical form. The roll must hence exhibit flexibility and a certain level of elasticity, which means that the roll can be returned to its cylindrical form while reopening the axial hollow passageway in a clearly defined manner. This requires the first inner turns to newly and stably maintain the axial hollow passageway. As a result, there should be no visible difference in appearance between a roll that has been returned from the compressed form to the uncompressed form and a roll that has not been previously subjected to compression.

Previous attempts at applying a binder to the first inner turns to assist in stably maintaining the axial hollow passageway produced a stiff core which consists of a number of turns of glued elongated material. Such a core lacks flexibility and shows low elasticity. As a result, after the roll has been compressed, it is difficult to reopen the axial hollow passageway in a manner leading to a well-defined axial hollow passageway.

Moreover, the first inner turns of elongated material (i.e. the turns of elongated material forming the core) are cohesively maintained together by the binder. The delamination force needed for separating the first inner turns is generally greater than the tear strength of the elongated absorbent material. It is hence difficult to separate the first inner turns without tearing apart the elongated absorbent material on which the binder is applied. As a result, it is not possible to use the elongated absorbent material on its whole length, e.g. up to the last sheet.

Additional attempts at applying an aqueous adhesive to the first inner turns was very difficult to dry, because the paper material generally has good absorbency towards liquids, and thus the water contained in the adhesive and thus the finished roll-shaped product is never completely dried. As a result, the paper material onto which the adhesive is applied exhibits some stickiness, which creates an unpleasant feeling among consumers.

In spite of the previous attempts there is still an unmet desire for a coreless roll of an absorbent sheet product which combines superior resistance to collapsing with improved flexibility and elasticity. It is also desirable for a coreless roll of an absorbent sheet product to be usable over essentially its whole length (i.e. essentially up to the last sheet) and to prevent sewage systems from clogging up. Additionally, it is desirable for a coreless roll of an absorbent sheet product to be capable of being provided in the compressed form, wherein, after the roll has been compressed, the axial hollow passageway can be reopened in a manner leading to a well-defined axial hollow passageway.

SUMMARY

The following presents a simplified summary of the invention in order to provide a basic understanding of some aspects of the invention. This summary is not an extensive overview of the invention. It is intended to neither identify key nor critical elements of the invention nor delineate the scope of the invention. Rather, the sole purpose of this summary is to present some concepts of the invention in a simplified form as a prelude to the more detailed description that is presented hereafter.

One aspect includes a coreless roll of an absorbent sheet product such as napkins, toilet paper, towels etc. made of a continuous web of absorbent material having a first end and a second end, the continuous web of absorbent material being wound such as to define an axial hollow passageway centrally positioned relative to the coreless roll and extending from one edge to another edge of the coreless roll and such that the first end is located on the outer side of the roll and the second end is located at the axial hollow passageway. The continuous web of absorbent material includes a coating composition including a specific polymer. In certain embodiments, the continuous web of absorbent material includes the coating composition is obtained by applying the coating composition to the second end.

In another aspect, the coreless roll is compressed into a compressed form.

Yet another aspect includes a process for the manufacture of a coreless roll of an absorbent sheet product including the steps of:

conveying a continuous web of absorbent material having a first end and a second end, where the absorbent material is composed of one or more tissue paper plies, such as 1 tissue paper ply, or 2 to 6, or 2 to 5, superposed tissue paper plies;

applying a coating composition including a specific polymer to the second end;

spirally winding the continuous web of absorbent material so as to produce a log of web of absorbent material, the continuous web of absorbent material being wound such as to define an axial hollow passageway centrally positioned relative to the log and extending from one edge to the other edge of the log and such that the first end is located on the outer side of the log and the second end is located at the axial hollow passageway; and cutting the log into multiple coreless rolls.

In certain embodiments, the process further includes the step of subjecting the coreless roll to compression in a direction perpendicular to the axial hollow passageway to produce a coreless roll in a compressed form. In particular embodiments, the process further includes the step of severing the continuous web of absorbent material substantially transversally to the machine direction to produce single but coherent sheets. This severing step can occur before or after applying the coating composition.

In particular embodiments, the polymer used in the coating composition has:

(i) a glass transition temperature lower than 20° C., or lower than 15° C., or lower than 10° C., or lower than 5° C., or lower than 0° C., or lower than −5° C., or lower than −10° C.; and (ii) a melting point greater than 20° C., or greater than 25° C., or greater than 30° C., or greater than 35° C., or greater than 40° C., or greater than 45° C.

In more particular embodiments, the coating composition is on the second end of the continuous web of absorbent material, and in yet more particular embodiments, only on the second end. The polymer used in the coating composition has:

(i) a glass transition temperature lower than 0° C., or lower than −5° C., or lower than −10° C.; and (ii) a melting point greater than 35° C., or greater than 40° C., or greater than 45° C.

In certain embodiments, the polymer used in the coating composition has a solubility in water at 25° C. of at least 40 g/l.

In particular embodiments, the coating composition is on the second end of the continuous web of absorbent material, and in yet more particular embodiments, only on the second end. The polymer used in the coating composition is represented by the following formula:

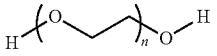

wherein, in the above formula, n represents an integer having an average value of 10 to 5000, or of 10 to 2500, or of 20 to 1000, or of 30 to 200, or of 50 to 150, or of 50 to 100.

The coreless rolls of an absorbent sheet according to the above aspects and embodiments, as well as embodiments disclosed below are distinguished by their excellent resistance to collapsing, as well as their excellent flexibility and elasticity. Moreover, the coreless rolls described above and below also exhibit excellent disintegrability in water and can be used up over their whole length.

In certain embodiments, the coating composition includes:

(a) at least 50 wt.-%, or at least 65 wt.-%, or at least 80 wt.-% of the polymer; and (b) not more than 50 wt.-%, or not more than 35 wt.-%, or not more than 20 wt.-% of further additives, each based on the total weight of the coating composition.

In more certain embodiments, the further additives can include plasticizers, reinforcing agents, fragrances, or dyes. In yet more certain embodiments, water is present in the coating composition in an amount of not more than 10 wt.-%, or in an amount of not more than 5 wt.-% based on the total weight of the coating composition. In particular embodiments, the amount of polymer is from 0.1 to 20 g/roll, or 0.1 to 10 g/roll, or 0.1 to 5 g/roll, or 0.5 to 2 g/roll.

In particular embodiments, the coating composition is applied in molten form or, after the addition of water, as an aqueous solution.

In particular embodiments, the polymer used in the coating composition is a polyether polyol, or, in more particular embodiments, a polyether polyol selected from polyethylene glycol, polypropylene glycol, and mixtures thereof, or, in yet more particular embodiments, polyethylene glycol. The polymer can have a number-average molecular weight of 800 to 250000, or of 1000 to 50000, or of 1500 to 15000, or of 1500 to 10000, or of 2000 to 7500, or 2500 to 4000.

In certain embodiments, the coating composition is free of saccharide.

In particular embodiments, the axial hollow passageway has a circumference and the coating composition is circumferentially applied and can be applied such that the resulting coating covers at least 10% of the second end, or at least 20%, or least 50%, or at least 75%, or at least 95%, of the second end.

In certain embodiments, the coating composition is applied continuously in the machine and axial direction or intermittently in the machine and/or axial direction.

In particular embodiments, the second end consists of at least one turn, or of at least two turns, or at least three turns, or three to fifty turns, or three to thirty turns or four to forty turns. A "turn" meaning one circumvolution of the spirally wound continuous web about the axial hollow passageway.

In certain embodiments, the absorbent material can be napkins, towels such as household towels, kitchen towels or hand towels, toilet papers, wipes, handkerchiefs, and facial tissues. In more certain embodiments, the absorbent material is toilet paper.

Where the present description refers to multiple embodiments/features, combinations of these multiple embodiments/features shall also be deemed as disclosed as long as this combination of multiple embodiments/features is technically meaningful.

Hereinafter, in the present description and the claims, the use of the term "comprising" should be understood as disclosing, as a more restricted embodiment, the term "consisting of" as well, as long as this is technically meaningful.

BRIEF DESCRIPTION OF THE FIGURES

The following detailed description can be read in connection with the accompanying drawings in which like numerals designate like elements and in which:

In FIGS. 1 to 4 the following reference numbers represent:

(1) Coreless roll
(2) Spirally wound continuous web of absorbent material
(3) Axial hollow passageway
(4) Edge
(5) First end
(6) Second end
(7) Coating composition
(8) Perforation line
FIG. 5 shows the application of the coating composition onto the continuous web of absorbent material by spraying.

FIG. 6 shows the application of the coating composition onto the continuous web of absorbent material by roll-coating.

DETAILED DESCRIPTION OF PARTICULAR EMBODIMENTS

1. Coreless Roll

Figure 1:
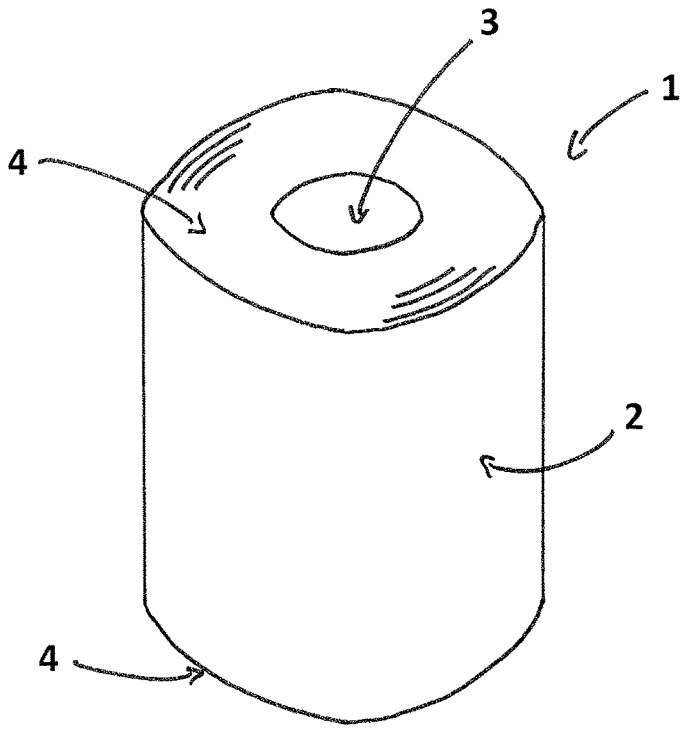
FIG. 1 is a schematic drawing showing a perspective view of a coreless roll according to an embodiment of the present invention.

The coreless roll of an absorbent sheet product according to an embodiment of the present invention is made of a spirally wound continuous web of absorbent material having a first end and a second end.

The continuous web of absorbent material can be made of a base tissue paper which can be obtained by the Conventional Wet Press or the Through Air Drying (TAD) manufacturing method or other manufacturing methods. The term "base (raw) tissue paper" ("tissue paper web") as used herein refers to a one-ply base tissue as obtained from the tissue machine. The base tissue paper has a low basis weight, in the range of 10 to 60 g/m$^2$, or 10 to 30 g/m$^2$.

The term "ply" as used herein refers to the one or more plies of base (raw) tissue paper in the final tissue paper product (e.g. toilet paper) as is/are obtained after processing ("converting") one or more tissue paper webs.

Based on the underlying compatibility of the production processes (wet forming), "tissue" production is counted among the papermaking techniques. The production of tissue is distinguished from paper production by its low basis weight and its higher tensile energy absorption index.

The tensile energy absorption index is arrived at from the tensile energy absorption in which the tensile energy absorption is related to the test sample volume before inspection (length, width, thickness of sample between the clamps before tensile load). Paper and tissue paper also differ in general with regard to the modulus of elasticity that characterizes the stress-strain properties of these planar products as a material parameter.

A tissue's high tensile energy absorption index results from outer or inner creping. The former is produced by compression of the paper web adhering to a dry cylinder as a result of the action of a crepe doctor or in the latter instance as a result of a difference in speed between two wires ("fabrics"). This causes the still moist, plastically deformable paper web to be internally broken up by compression and shearing, thereby rendering it more stretchable under load than an uncreped paper. A high tensile energy absorption index can also be achieved by imparting to the tissue a 3D structure by the wires themselves. Most of the functional properties typical of tissue and tissue products result from the high tensile energy absorption index (see DIN EN 12625-4 and DIN EN 12625-5).

Typical properties of tissue paper include the ready ability to absorb tensile stress energy, their drapability, good textile-like flexibility, properties which are frequently referred to as bulk softness, a high surface softness, a high specific volume with a perceptible thickness, as well as high liquid absorbency and, depending on the application, a suitable wet and dry strength as well as an interesting visual appearance of the outer product surface. These properties allow tissue paper to be used, for example, as cleaning cloths (e.g. household towels), sanitary products (e.g. toilet paper, hand towels) and wipes (e.g. cosmetic wipes, facial tissues).

According to one embodiment, the continuous web of absorbent material is composed of 1 tissue paper ply or 2 to 5 superposed tissue paper plies.

The tissue paper can be produced from paper-making fibers according to "Conventional Processes" as in the manufacture of "Dry Crepe Tissue" or "Wet Crepe Tissue" or "Processes for Structured Tissue" such as the Through Air Drying (TAD) manufacturing method, the manufacture of uncreped through-air dried (UCTAD) tissue, or alternative manufacturing methods, e.g. the Advanced Tissue Molding System (ATMOS) of the company Voith, or Energy Efficient Technologically Advanced Drying eTAD of the company Georgia Pacific, or Structured Tissue Technology SST of the company Metso Paper. Hybrid processes like NTT (New textured Tissue) which are alterations of the conventional processes can be used, too.

The conventional dry crepe manufacturing method comprises the steps of:

- pressing and drying the wet paper fibers as a sheet on a large-diameter, heated cylinder (also called Yankee dryer); and
- subsequently detaching and creping the sheet of dried paper fibers by a metal blade applied against said cylinder, across its direction of rotation.

The creping operation creates undulations in the sheet across its direction of travel. The creping operation increases the thickness of the sheet, and confers elasticity and gives touch (soft touch) properties to the sheet.

The TAD manufacturing method comprises the steps of:

molding the sheet of wet paper fibers on a fabric; and subsequently drying the sheet, at least partly, by means of a current of hot air passing through it.

Subsequently, the dried sheet may be creped.

Further, in the manufacture of a tissue web (as preferred embodiment of the continuous web of absorbent material to be used), a process as described in PCT/EP2015/059326 (application date: 29.04.2015; title: "Tissue paper comprising pulp fibers originating from *Miscanthus* and method for manufacturing the same", incorporated by reference) can be used. Specifically, reference is made to the description according to item 3 on pages 22 to 27 of this application and details of the TAD process (e.g. 3-D-shaped fabric, permeable drying cylinder, etc.) disclosed therein. The parameters described in this passage are also valid for the use of the ATMOS technology.

Once the tissue paper has been manufactured, a distinct manufacturing operation called converting operation is typically employed to form the tissue paper product (i.e. the paper towel, toilet tissue rolls, bathroom tissue, wiping tissue, kitchen tissue rolls, handkerchiefs, etc.).

In one further embodiment of the continuous web of absorbent material, the absorbent material is a "nonwoven material". The term "nonwoven" is very common in the art and can be further defined in the manner described in ISO 9092:2011, also for the purpose of embodiments of the present invention. Typical nonwoven manufacturing techniques include the air-laid technology, spun-laid technology, dry-laid technology, and wet-laid long fibers technology. The nonwoven web used according to this embodiment can be a single ply or multi-ply web.

According to one particular aspect of this embodiment, the absorbent nonwoven-based web used in the coreless roll includes cellulosic fibers. In this case, the content of the cellulosic fibers, based on the total weight of all fibers present in the nonwoven web, is at least 20 wt.-%, or at least 50 wt.-%, or at least 80 wt.-%. The remaining fibers are in these cases non-cellulosic fibers such as synthetic fibers.

The aforementioned "paper-making fibers" (which can also be referred to as "cellulosic fibers") can be produced from virgin and/or recycled paper pulp raw material. The cellulosic fibers can contain as a main structure-building component the long chain fibrous cellulose portion which is present in naturally occurring cellulose-containing cells, in particular those of lignified plants. In particular embodiments, the fibers are isolated from lignified plants by digestion steps removing or reducing the content of lignin and other extractables and optional bleaching steps. The cellulosic fibers can also stem from non-wood sources such as annual plants.

Suitable cellulosic fibers may be of regenerated type (e.g. Lyocell), although the use of other types of pulps is preferred. The pulps employed can be a primary fibrous material ("virgin fibers") or a secondary fibrous material (recycled pulps). The pulp can stem from lignin-free or low lignin sources, such as cotton linters, esparto (alfa) grass, bagasse (e.g. cereal straw, rice straw, bamboo, or hemp), kemp fibers, *Miscanthus* grass fibers, or flax (also referred to as "non-wood fibers" in the description and the claims). In particular embodiments, the pulp is produced from lignocellulosic material, such as softwood (which typically originates from conifers) or hardwood (typically from deciduous trees).

It is possible to use "chemical pulps" or "mechanical pulps", whereby the use of chemical pulps is preferred.

"Chemical pulps" are, according to DIN 6730, fibrous materials obtained from plant raw materials of which most non-cellulosic components have been removed by chemical pulping without substantial mechanical post treatment. "Mechanical pulp" is the general term for fibrous material made of wood entirely or almost entirely by mechanical means, optionally at increased temperatures. Mechanical pulp can be subdivided into the purely mechanical pulps (groundwood pulp and refined mechanical pulp) as well as mechanical pulps subjected to chemical pre-treatment, such as chemo-mechanical pulp (CMP), or chemo-thermo mechanical pulp (CTMP).

Figure 2:
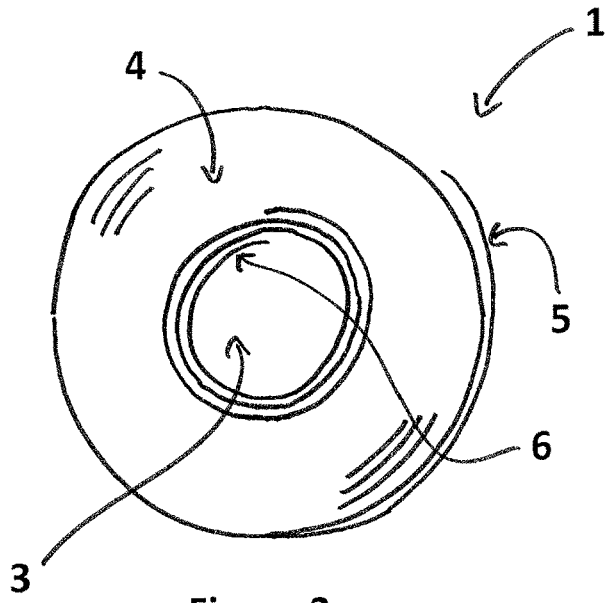
FIG. 2 is a schematic drawing showing a lateral view of a coreless roll according to an embodiment of the present invention. The second end as represented in FIG. 2 has three turns.

Referring to FIGS. 1 and 2, the continuous web of absorbent material (2) is spirally wound such as to define an axial hollow passageway (3) centrally positioned relative to the roll (1), and which extends from one edge (4) to the other edge (4) of the roll. The term "axial hollow passageway" herein refers to a tubular opening that extends through the roll along its central axis. The axial hollow passageway enables the end user to mount the roll on the spindle of a roll holder. When the roll is mounted on the spindle of a roll holder, the absorbent material is dispensed from the first end (located at the outside of the roll) while the roll is allowed to freely rotate about its central axis. The axial hollow passageway has a diameter of from 10 mm to 70 mm, or from 20 to 50 mm.

The axial hollow passageway (3) extends from one edge (4) to the other edge (4) of the coreless roll. The coreless roll has a cylinder-shaped circumferential surface and opposite flat ends (i.e. edges), which are formed when the log roll is cut into multiple rolls at the end of the winding process. The term "edge", in this embodiment, refers to the flat portion which is located on one side of the roll perpendicular to its center axis.

The continuous web of absorbent material (2) has a first end (5) and a second end (6). The first end (5) is located at the outside of the roll and the second end (6) is located at the axial hollow passageway (3). Hence, the continuous web of absorbent material consists, in the machine direction, of the first end and the second end and a middle portion located between these ends. The combined lengths of the first end, the second end and the middle portion define the length of the continuous web of absorbent material which forms one roll. The continuous web of absorbent material web includes the coating composition according to embodiments discussed above and below. In particular embodiments, the continuous web of absorbent material web is obtained by applying the coating composition to the second end. This leads to a continuous web of absorbent material web wherein the remaining portions, i.e. the first end and the middle portion can be essentially or completely free of coating composition. The resulting continuous web of absorbent material web hence can be distinguished from known continuous webs of absorbent material, e.g. lotioned toilet paper, in which the same coating composition (e.g. lotion) is applied to the entire continuous web.

However, this does not exclude that the coating composition can be applied to the second end of the continuous web of absorbent material while in addition a lotion (which necessarily differs from the coating composition) is applied to one side of the entire continuous web of absorbent material.

Further embodiments of the coreless roll relate to a continuous web of absorbent material obtained by applying the coating composition to the second end thereof, wherein a part of the remaining portions, i.e. the first end and the middle portion carry the composition. For example, less than 20%, or less than 10%, or less than 5% of the total area of the remaining portion carries the coating composition.

In one embodiment, the second end (6) consists of at least one turn, or at least two turns, or at least three turns, or three to fifty turns, or three to thirty turns or four to forty turns. FIG. 2 shows for instance three turns at the second end (6) of the web.

In one embodiment, the coreless roll is provided in a compressed form. The term "compressed form" herein refers to a form in which the roll cross section has an oval shape. When the roll is in the compressed form, the axial hollow passageway adopts the shape of a thin, typically oval slit and is no longer able to receive the spindle of a roll holder. As a result, the roll requires less space and storage and transport costs can be reduced. The coreless roll of embodiments of the present invention can be returned from the compressed form (oval) to the uncompressed form (cylindrical) by applying pressure along the longer side (diameter) of the oval-shaped roll, i.e. perpendicular to the axis of the roll.

2. Coating Composition

In embodiments of the present invention, a coating composition comprising a specific polymer is applied to the second end of the continuous web of absorbent material. The specific polymer is described in more detail in section 2.1 below. Accordingly, this polymer can be either characterized by properties (i), (ii) and optionally (iii) or defined by formula (I).

In one embodiment, the coating composition includes:

(a) at least 50 wt.-% of said polymer, or at least 65 wt.-%, or at least 80 wt.-%, or at least 85 wt.-%, or at least 90 wt.-%, or at least 95 wt.-%;

(b) not more than 50 wt.-%, or not more than 35 wt.-%, or not more than 20 wt.-%, or not more than 15 wt.-%, or not more than 10 wt.-%, or not more than 5 wt.-% of further additives such as plasticizers, reinforcing agents, fragrance, dyes etc.;

(c) optionally water in an amount of not more than 10 wt.-%, or in an amount of not more than 5 wt.-%;

each based on the total weight of the coating composition.

In one further embodiment, the coating composition consists of these ingredients in the stated amounts.

In one particular embodiment, this coating composition consists of at least 95 wt.-%, or at least 98 wt.-% of the polymer and optionally water in an amount of not more than 5 wt.-%, or not more than 2 wt.-% water. In one more particular embodiment, the coating composition consists of the polymer.

This coating composition can be applied to the continuous web of absorbent material (in particular its "second end") in a molten state after heating to a temperature at or above the specified melting point, e.g. by spraying, roll-coating, slot-die application or any other suitable application method known in the art.

In another embodiment, the coating composition is applied as an aqueous solution. In this embodiment, water is added to the coating composition and used as solvent for the polymer and the further additives, if present. The aqueous solution of the coating composition preferably contains the polymer in an amount of at least 5 wt.-%, or at least 10 wt.-%, or at least 30 wt.-% based on the total weight of the aqueous solution.

Water can be present in an amount which is greater than 20 wt. %, or in an amount greater than 35 wt.-%, or greater than 50 wt.-%, based on the total weight of the aqueous solution.

This aqueous solution of the coating composition can be applied as it is, such as at room temperature, to the continuous web of absorbent material (in particular its "second end"), e.g. by spraying, roll-coating, or any other suitable application method known in the art.

After the application of the aqueous solution, the continuous web of absorbent material can be dried, for instance by longer storage at ambient conditions or other suitable techniques known in the art. Depending on the water content, such drying step may also be unnecessary since the web of absorbent material itself will remove water from the aqueous solution thereby leaving back the coating composition on the web.

In one embodiment, the coating composition is free of saccharide. The term "saccharide" is to be understood broadly and includes monosaccharides, disaccharides, oligosaccharides (at least 3 saccharide units) and polysaccharides such as starch or cellulose as well as saccharide-based polymers such as cellulose ether derivatives such as carboxymethyl cellulose (CMC) and methyl cellulose.

The coating composition can be applied onto at least one of the two sides of the continuous web, i.e. the upper and/or the lower side of the continuous longitudinal web, or between the base tissue paper plies forming the web. The term "upper side" herein refers to the side of the continuous web that is oriented towards the outside of the roll when the web is spirally wound. In one particular embodiment, the coating composition is applied onto the lower side, i.e. the side oriented towards the axial hollow passageway.

The coating composition can be applied onto the continuous web before it is spirally wound to produce the roll. As a result of winding, the coating composition is applied circumferentially with respect to the axial hollow passageway. In particular embodiments, the coating composition is applied onto the web such that, with respect to the total area of the second end (i.e. the area carrying the resulting coating), at least 50%, or at least 75%, or at least 95% are coated.

If the coating is applied to the second end of the web intermittently in the machine and/or axial direction, for instance with respect to the individual circumvolutions of the web about the axial hollow passageway, i.e. if one or more circumvolutions are not fully coated when viewed from the edges of the roll, it is also preferred that the area carrying the resulting coating constitutes at least 10% of the total area of the second end, or at least 20% of the total area, or at least 35%, or at least 50% of the total coated area, or at least 75%, or at least 95% of the total area of the second end.

The coating composition can be applied onto the second end of the continuous web to provide a full or partial coating. The term "full coating" herein refers to a coating that is applied continuously in the machine and the axial (cross) direction, i.e. the second end of the web does not include any uncoated portions (see e.g. FIG. 3).

The term "partial coating" herein refers to a coating composition that is applied onto the continuous web such that it partially covers the surface of the web (i.e. its second end). A partial coating occurs for instance if the coating is applied to the second end of the web intermittently in the machine and/or axial direction. The coating composition can be applied onto the web so as to form predetermined coating patterns. There is no particular limitation to the predetermined coating pattern. The partial coating may form coherent (e.g. stripes, lines, or waves) or separate deposits (e.g. dots, squares, circles or any other geometric shape).

In one embodiment of a partial coating, the coating is applied intermittently in the machine and/or axial direction, e.g.

- continuously in the machine direction, but intermittently in the axial (cross) direction, e.g. in the form of one or more parallel stripes running in the machine direction (see e.g. FIG. 4*a*),
- continuously in the axial (cross) direction, but intermittently in the machine direction, e.g. in the form of one or more parallel stripes running in the axial direction, i.e. from one edge of the roll to the other edge,
- intermittently in the machine and axial (cross) direction, e.g. in the form of parallel stripes crossing each other.

Figure 4A:
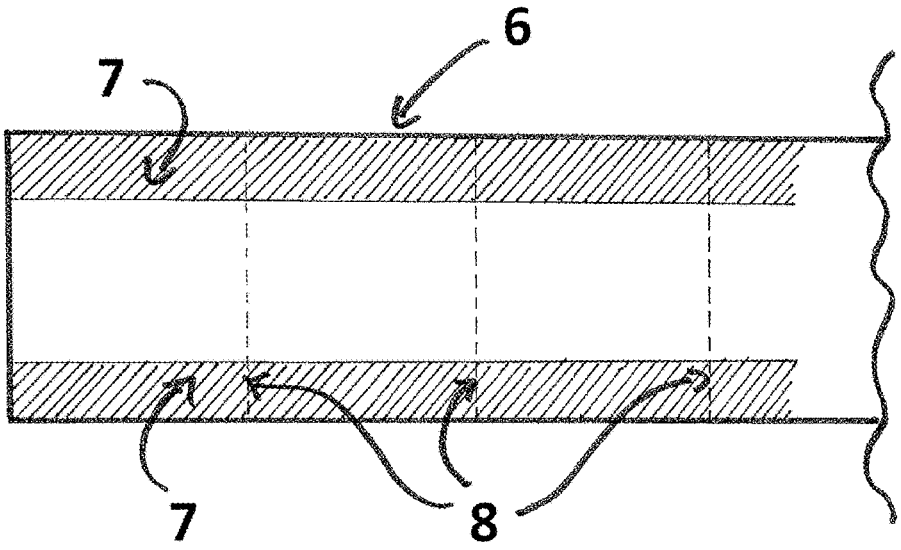
FIGS. 4*a* and 4*b* are schematic drawings of the second end of an unwound continuous web of absorbent material according to different embodiments of the present invention. The grey shading in FIGS. 4*a* and 4*b* represents the coating composition which is applied intermittently onto the second end, as stripes and dots, respectively.
Figure 4B:
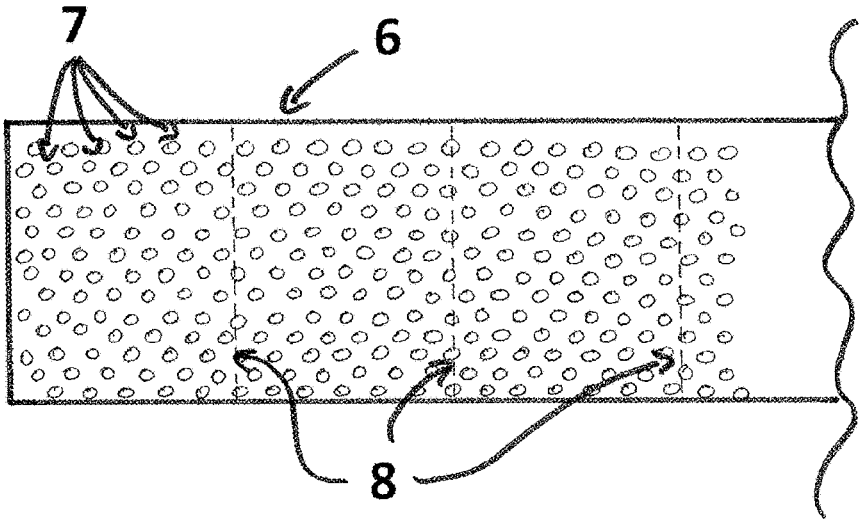

In one embodiment of a partial coating, the coating is applied intermittently in the form of dots as shown in FIG. 4*b*. The dots can form a regular or irregular pattern, as results e.g. from spraying or roll-coating.

In one embodiment, the coating composition is intermittently applied such that it covers at least 35% of the second end surface, or at least 50% of the second end surface, or at least 75%, or at least 95% of the total surface of the second end.

2.1 Polymer

The coating composition includes a specific polymer. In one embodiment, the polymer has:

(i) a glass transition temperature lower than 20° C., or lower than 15° C., or lower than 10° C., or lower than 5° C., or lower than 0° C., or lower than −5° C., or lower than −10° C.; and (ii) a melting point greater than 20° C., or greater than 25° C., or greater than 30° C., or greater than 35° C., or greater than 40° C., or greater than 45° C.;

(iii) optionally a solubility in water at 25° C. of at least 40 g/l.

In particular embodiments, the polymer has a (i) glass transition temperature which is lower than 0° C., or lower than −5° C. or than −10° C. The glass transition temperature defines a change/transition with respect to the mechanical properties of the polymer. When the temperature is below the glass transition temperature, the polymer tends to adopt a relatively hard and brittle state similar to that of glass. However, when the temperature is above the glass transition temperature, the polymer is in a more elastic, e.g. rubber-like, state which contributes to the favorable mechanical properties of the coreless roll, in particular its resistance to collapsing and the flexibility/elasticity of the coating when the coreless roll is compressed.

Furthermore, in particular embodiments, the polymer has a (ii) melting point greater than 35° C., or greater than 40° C., or greater than 45° C. This property ensures that the polymer can be applied as hot melt in one embodiment and solidifies at room temperature.

In particular embodiments, the polymer exhibits a (iii) solubility in water at 25° C. of at least 40 g/l, or 200 g/l, or 500 g/l. The solubility of the polymer in water ensures that the absorbent sheet product (in particular toilet paper, etc.) has good flushability and biodegradability. Due to the fairly high solubility of the polymer it dissolves upon contact with water in the sewage system, or at least quickly forms a dispersion. As a result, sewage systems can be effectively prevented from clogging up. For other embodiments of the coreless roll which are normally not disposed via the sewage system such as napkins, towels, e.g. household towels, kitchen towels or hand towels, toilet papers, wipes and facial tissues, feature (iii) is not required.

The polymer is selected such that the conditions of (i) glass transition temperature, and (ii) melting point and optionally also (iii) solubility in water as described above are satisfied.

The definition of "polymer" as used herein also includes a blend of at least two different polyether polyols, especially a blend of polyethylene glycol and polypropylene glycol. The term "polymer" should also comprise a copolymer consisting of at least two different ether glycols, especially a copolymer of ethylene glycol and propylene glycol. It is preferred in certain embodiments that each polymer in such blends meets the criteria (i), (ii) and optionally (iii).

Together, as mentioned before, the (i) glass transition temperature and the (ii) melting point of the polymer contribute to the elastic behavior of the polymer at room temperature, where the coreless roll is normally used (generally in the range of from 20 to 25° C.). Furthermore, when it is used in the coating composition, the polymer provides a rolled absorbent sheet product which combines excellent resistance to collapsing, flexibility and elasticity.

Therefore, the glass transition temperature and the melting point described above are to be understood as peak temperatures, as can be determined by Dynamic Mechanical Analysis (DMA) under the conditions specified in the examples.

DMA is a technique which consists in applying an oscillating (sinusoidal) force to a sample of material, e.g. a polymer, and measuring the resulting displacement thereof. This measurement enables determining the strain (stiffness) and damping of the material, which are typically reported as "modulus" and "tan δ". More specifically, the "tan δ" represents the ratio of the loss modulus to the storage modulus of the material. Hence, by measuring the phase lag in the displacement compared to the applied force, it is possible to determine the damping properties of the material. When tan δ is plotted against the temperature, the glass transition temperature and the melting point of the material can be observed as peaks, since the material absorbs energy as it passes through the glass transition and as it melts.

The (i) glass transition temperature and the (ii) melting point of the polymer can be determined by using e.g. a dynamic mechanical analyzer DMA 8000 as available from PerkinElmer®.

In one embodiment, the polymer is a polyether polyol, in particular a polyether polyol selected from polyethylene glycol, polypropylene glycol, and mixtures thereof, or more particularly polyethylene glycol.

In one embodiment, the polymer has a number-average molecular weight of 800 to 250000, of 1000 to 50000, of 1500 to 15000, of 1500 to 10000, of 2000 to 7500, or 2500 to 4000.

In a particular embodiment, the polymer is polyethylene glycol having a number-average molecular weight of 800 to 250000, of 1000 to 20000, of 1500 to 10000, of 2000 to 7500, of 2500 to 6500, or of 2500 to 4000.

The number-average molecular weight of the polymer can be determined by techniques known in the art, such as Gel Permeation Chromatography (GPC).

In another embodiment, the polymer is represented by the following formula (I):

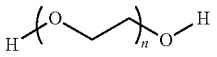

(I)

wherein, in the above formula, n represents an integer having an average value of 10 to 5000, of 10 to 2500, of 20 to 1000, of 30 to 200, of 50 to 150, or of 50 to 100. In particular embodiments, n represents an integer having an absolute value of 10 to 5000, of 10 to 2500, of 20 to 1000, of 30 to 200, of 50 to 150, or of 50 to 100.

The amount of polymer in the coating composition can be set such that the polymer is applied to the second end in an amount of from 0.1 to 20 g/roll, 0.1 to 10 g/roll, 0.1 to 5 g/roll, or 0.5 to 2 g/roll. When the amount of polymer applied to the second end is less than 0.1 g/roll, the desired properties of flexibility and elasticity, as well as excellent resistance to collapsing, may not be fully developed. Conversely, when the amount of polymer applied to the second end is greater than 20 g/roll, the roll exhibits excellent resistance to collapsing, as well as flexibility and elasticity, but manufacturing costs may become high.

2.2 Additives

Plasticizer

The coating composition may include a plasticizer, for instance a known plasticizer of an ester type. The plasticizer may contribute to the film-forming properties of the coating composition. It is selected such as to be compatible with the polymer described above. In one embodiment, the coating composition is free of plasticizer.

One type of plasticizer may be used on its own or two or more types may be used in combination.

From the viewpoint of stability over time, the content of the plasticizer in the coating composition may be limited to no greater than 20 wt % of the total solids content concentration, or no greater than 10 wt %, or no greater than 5 wt %.

Strengthening Agent

The coating composition may include a strengthening agent.

In one embodiment, the coating composition is free of strengthening chemical additives, such as strength resins, for instance free of the water-soluble cationic or anionic polymers described below. When the coating composition includes a strengthening agent, a water-soluble cationic polymer, and/or a water soluble anionic polymer as known in the art can be used.

Other Additives

The coating composition may include as appropriate various types of known additives as long as the effects of the coating composition are not inhibited. Examples include a fragrance, a colorant, a surfactant, an anti-scaling agent, and an anti-bacterial agent, as well as inorganic or organic fillers.

One type thereof may be used on its own or two or more types may be used in combination.

3. Absorbent Product

The coreless roll has many applications in the field of sanitary or domestic absorbent products. In particular, the roll of can be an absorbent sheet product chosen among the group of napkins, towels such as kitchen towels or hand towels, toilet paper, wipes and facial tissues.

The absorbent sheet product can be made of a continuous web of absorbent material having a first end and a second end, which consists of at least one ply of base tissue paper with typical basis weight of from 8 to 60 g/m$^2$, or 10 to 30 g/m$^2$.

In one embodiment, the continuous web of absorbent material is a single ply web made of tissue paper or a multiple-ply web made of e.g. 2 to 5 superposed tissue paper plies. To achieve a multiple-ply absorbent sheet product, the one-ply base tissues are combined in a converting step to the final ply count, which may be from e.g. 2 to 5 depending on the targeted properties of the final product. In particular embodiments, the total basis weight of the resulting multiple-ply web does not exceed 120 g/m$^2$, or is lower than 65 g/m$^2$, or is lower than 55 g/m$^2$.

The second end of the continuous web can be coated with the coating composition (i.e. one comprising a polymer as described above) and spirally wound to achieve a roll of absorbent sheet product, such as a toilet paper roll. The coating composition can be applied onto the second end by using techniques known in the art. "Spraying" and "roll coating" belong to these well-known techniques.

The coating composition can be applied onto at least one of the two sides of the continuous web, i.e. the upper and/or the lower side of the continuous longitudinal web, or between the base tissue paper plies forming the web.

When the web is a multiple-ply web, e.g. one having 2 to 5 superposed tissue paper plies, the coating composition can be applied onto one or both sides of one or more plies, e.g. onto all the plies. In one embodiment, the coating composition is applied onto one of the outer plies of the web, or onto the outer ply which is oriented towards the axial hollow passageway in the finished absorbent sheet product (i.e. the outer ply which is the one closest to the axial hollow passageway). The outer ply can be coated on one or both sides, or on its lower side, i.e. the side oriented towards the axial hollow passageway.

The absorbent sheet product can be selected from napkins, towels such as kitchen towels or hand towels, toilet paper, wipes and facial tissues. The term "toilet paper" herein refers to a soft and strong base tissue paper, which is used to clean the posterior after using the toilet (sometimes also referred to as "bathroom tissue").

Embodiments of the present invention also relate to the use of the coreless roll as toilet paper, household towel, kitchen towel, wipe, facial or napkin.

According to one embodiment, the absorbent sheet product is a toilet paper composed of 2 to 5 superposed tissue paper plies, e.g. 2 to 4 tissue paper plies, in which the coating composition is applied onto at least one outer ply of the continuous web, or on the lower side of the outer ply closest to the axial hollow passageway.

The dimensions of the coreless roll are not limited and depend greatly on the target absorbent sheet product. An individual roll can for instance have a diameter (edge diameter) of from 5 cm to 50 cm, or from 8 cm to 20 cm. The axial hollow passageway can have a diameter of from 10 mm to 70 mm, or from 20 to 50 mm. The width of the roll (i.e. distance between one edge to another edge) can range from 60 mm to 800 mm, or from 70 mm to 400 mm, or from 80 mm to 150 mm.

The continuous web of absorbent material forming the absorbent sheet product can have a total length in the machine direction of from 1 m to 60 m, from 1.5 m to 50 m, or from 2 m to 40 m. Optionally, the web can be partially severed in the machine direction such that it consists of consecutive single but coherent sheets. A single sheet can have a length (in the machine direction) of from 80 mm to 300 mm, from 100 mm to 250 mm, or from 100 mm to 200 mm.

4. Process for the Manufacture of Coreless Rolls and Absorbent Products

A process for the manufacture of a coreless roll as described before and below includes the steps of:

(A) conveying a continuous web of absorbent material having a first end and a second end, which is optionally composed of one tissue paper ply or 2 to 5 superposed tissue paper plies;

(B) applying a coating composition to the second end;

(C) spirally winding the continuous web of absorbent material so as to produce a log of web of absorbent material, the web of absorbent material being wound such as to define an axial hollow passageway centrally positioned relative to the log and extending from one edge to another edge of the log and such that the first end is located on the outer side of the log and the second end is located at the axial hollow passageway;

(D) optionally severing the continuous web of absorbent material substantially transversally to the machine direction to produce single but coherent sheets;

(E) cutting the log into multiple coreless rolls.

According to one embodiment, the aforementioned process for the manufacture of a coreless roll includes the further step of:

(F) subjecting the coreless roll to compression in a direction perpendicular to the axial hollow passageway to produce a coreless roll in a compressed form.

The coreless roll can be manufactured by using a commercially available converting machine. A suitable converting machine is available, for example, from the Paper Converting Machine Company (PCMC), Europe.

The description of the process below referring to machine modules/units is to be understood as an illustration of a machine suitable for manufacturing the roll according to embodiments of the present invention. The use of other kinds of machines/units known in the art is also possible.

Figure 5:
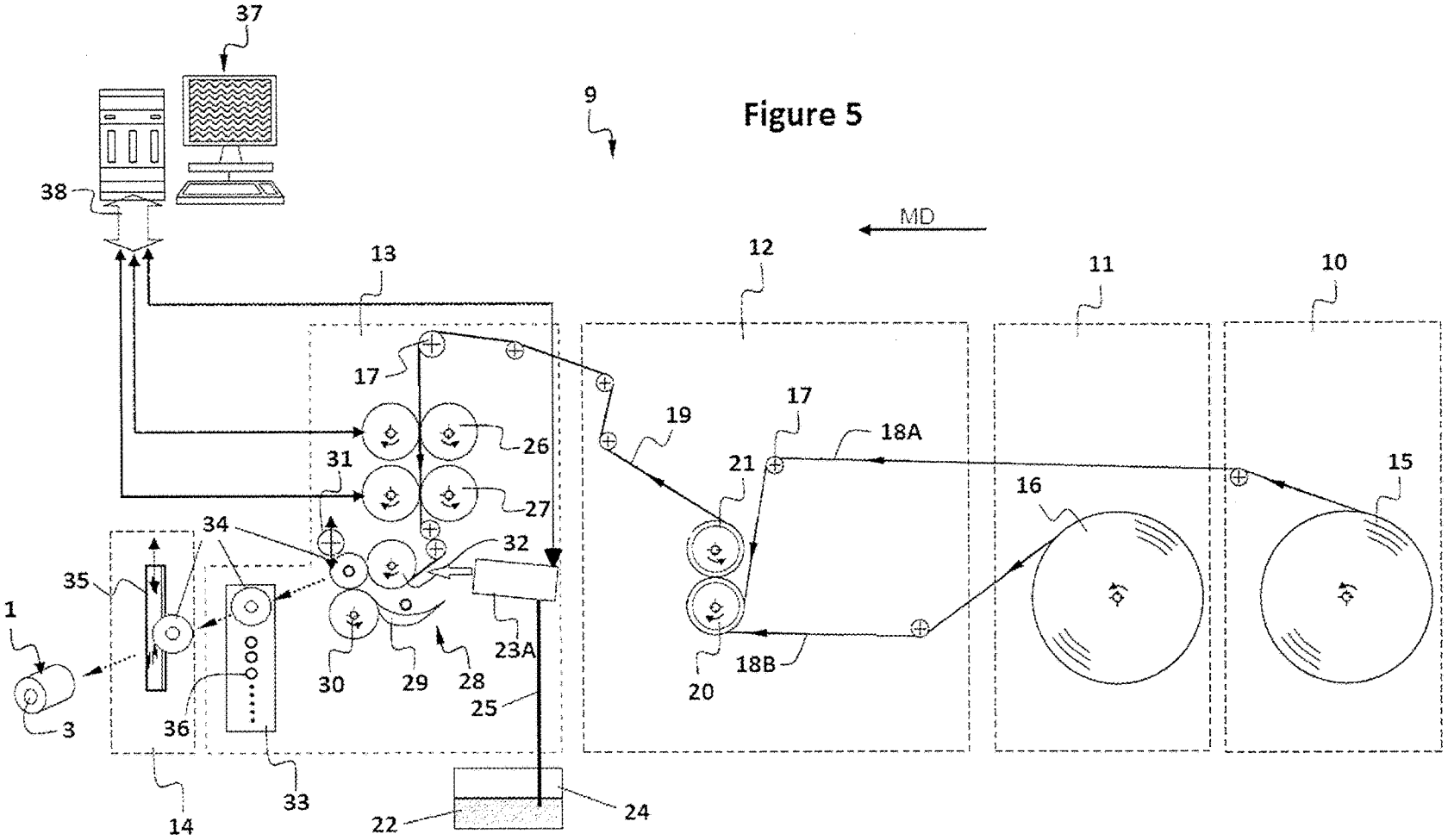
FIG. 5 is a schematic drawing showing a cross-section view of a converting machine (9) illustrating the manufacturing of coreless rolls according to one embodiment of the invention.
Figure 6:
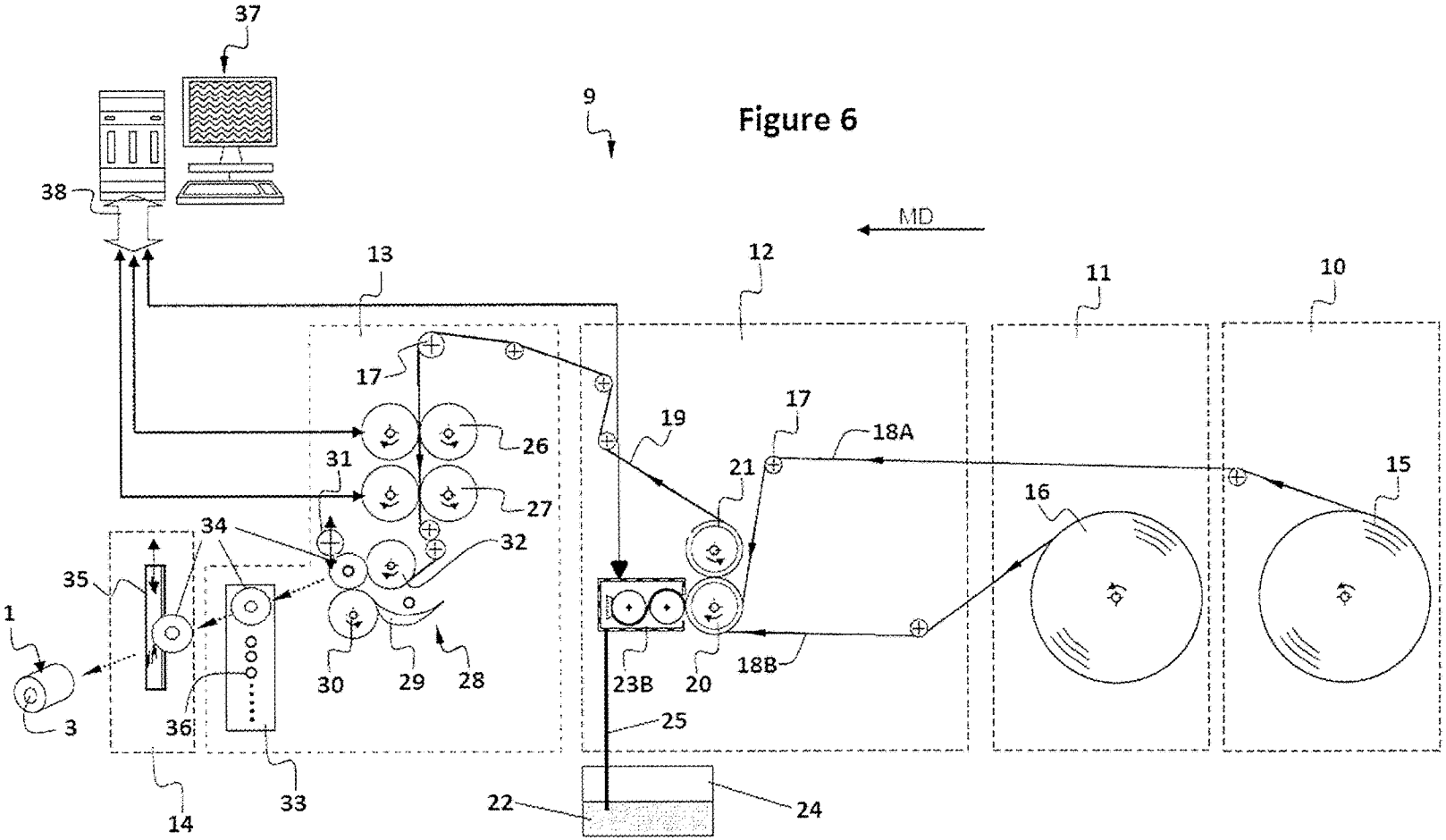
FIG. 6 is a schematic drawing showing a cross-section view of a converting machine (9) illustrating the manufacturing of coreless rolls according to another embodiment of the invention.

Referring to FIGS. 5 and 6, the process for the manufacture of a coreless roll includes the steps of:

(A) Conveying a continuous web of absorbent material (19) having a first end and a second end.

The continuous web of absorbent material (19) consists of one or more plies of base tissue paper having a basis weight of from 8 to 60 g/m$^2$, or from 10 to 30 g/m$^2$. The base tissue paper is typically provided as large parent rolls (15) and (16) having a width of from 1.80 m to 7 m as obtained from the tissue machine. The parent rolls (15) and (16) are mounted on the unwinding units (10) and (11) of converting machine (9). The number of parent rolls to be used corresponds to the ply count in the target absorbent sheet product. In FIGS. 5 and 6, two parent rolls (15) and (16) each providing one ply of bathroom tissue (18A) and (18B) are employed to produce a two-ply toilet paper roll (1).

The plies (18A) and (18B) are fed from the unwinding units (10) and (11) to an embossing unit (12), in which the plies are superposed and combined (associated) in order to produce a continuous web of absorbent material (19).

The embossing unit includes an engraved cylinder (20) and a mating rubber cylinder (21), both rotating in opposite directions, and optionally a glue dispenser (not shown). The engraved cylinder can be engraved with a microstructure pattern combining various embossing tips. The engraved cylinder can perform a simple- or a double-level engraving into the superposed plies.

The glue dispenser, if any, typically includes a vat (a reservoir for glue), an applicator cylinder and a dipping cylinder. The applicator cylinder abuts the superposed base tissue plies against the engraved cylinder. The dipping cylinder (not shown) picks up the adhesive in the vat and transfers the adhesive to the applicator cylinder (not shown). The applicator cylinder is arranged to exercise a determined pressure on the engraved cylinder at the distal area of protuberances of the embossed web. At said determined pressure, the adhesive crosses through the web and bonds the plies. The amount of adhesive used for ply bonding can be from 0.1 g/m$^2$ to 5.0 g/m$^2$, or from 0.2 g/m$^2$ to 1.0 g/m$^2$. An example of a suitable adhesive for ply bonding is Swift® tak 1004 available from H.B. Fuller, Europe.

The embossing step described above is used to combine plies of base tissue and, also, to emboss or micro-emboss at least one of the plies in order to generate esthetical effects or modify the thickness, the softness, or the suppleness of the resulting continuous web (19).

(B) Applying a coating composition onto the second end of the continuous web so as to form a full or partial coating. The coating composition is applied onto the second end by techniques known in the art. It is possible to use, amongst other techniques, spraying or roll coating.

The term "spraying" herein refers to the coating composition being applied onto the continuous web in the form of a dispersion of fine liquid droplets in a gas (i.e. a spray). A spray can be formed by using a spray nozzle (spray gun) having a fluid passage that is acted upon by mechanical forces which atomize the liquid. The liquid droplets can have a size of from 1 μm to 1000 μm, e.g. 10 μm to 400 μm.

The converting machine (9) can be equipped with one or more spray guns (23A), e.g. 1 to 8 spray guns, which can be placed at any location of the converting line as long as this is meaningful in view of the desired results (coatings of second end). The spray gun(s) (23A) can be placed before the embossing unit (12) such that the coating composition (22) is applied e.g. onto an outer ply or between the plies. In a particular embodiment, the spray gun(s) (23A) is/are placed between the cutting module (27) and the winding module (28) such that the coating composition (22) is applied onto the lower side of an outer ply (as shown in FIG. 5).

The spraying system includes one or more spray gun(s) (23A), a vat (24) and pipes (25) feeding the coating composition (22) from the vat to the spray gun(s) (23A). Optionally, the spraying system is equipped with a heating system (e.g. heating jacket, heat guns etc., not shown), which heats the coating composition in the vat (24), pipes (25) and/or gun(s) (23A) such that the composition is maintained in a liquid state during spraying. In particular, the heating system can heat the coating composition at a temperature above the melting point of the polymer used in the composition.

Spray guns suitable for spraying the coating composition of the present invention are available e.g. from Walther Spritz- and Lackiersysteme GmbH, Germany.

The term "roll coating" herein refers to the coating composition being directly applied onto the second end by means of an applicator roll. "Roll-to-roll coating" and "reverse-roll coating" belong to well-known techniques which can be used for roll coating. Referring to FIG. 6, the roll-coating system includes dipping cylinder and applicator cylinders (23B), a vat (24) and pipes (25) feeding the coating composition (22) from the vat to the dipping and applicator cylinders (23B). The roll-coating system includes optionally a heating system as described above (not shown). The roll-coating system can be placed at any location of the converting line as long as this is meaningful. The roll-coating system can be placed, for example, on the embossing unit in a manner that the applicator cylinder (23B) abuts against the engraved cylinder (20) or another cylinder (as shown in FIG. 6).

The spray gun(s) (23A) or the roll-coater (23B) can be adjusted to apply a continuous coating in the machine and axial direction or an intermittent coating (e.g. stripes, dots etc.) in the machine and/or axial direction.

(C) Spirally winding the continuous web (19) so as to produce a log of web of absorbent material (34).

The continuous web (19) is fed from the embossing unit (12) to the rewinding unit (13) in which the web (19) is spirally wound so as to produce a log of web of absorbent material (34). The rewinding unit (13) includes a perforating module (26), a cutting module (27), a winding module (28) and an extraction module (33). The rewinding unit (13) winds the continuous web (19) into multiple logs (34).

The winding module (28) is arranged to wind the continuous web (19) so as to produce logs of web (34). The winding module (28) can be of the peripheral type (center winding) or the surface type (surface winding). The winding module includes a rolling surface (29), a first winding roller (30), a second winding roller (31), a third winding roller (32), and a temporary core supplier (not shown). The log is formed by winding the continuous web onto a temporary core (36) which maintains a well-defined axial hollow passageway. The temporary cores (36) are sequentially provided by the core supplier through the rolling surface (29) before the beginning of a new log production cycle. The temporary core (36) can be made, for example, of plastic or cardboard. A "fugitive glue" (pick-up glue) can be used to pick up the second end of the web (19) onto the temporary core (36) at the beginning of a new production cycle.

The log (34) is maintained in position during the winding by the first, second and third winding rollers (30), (31) and (32) rotating in surface contact with the log (34). One of the winding rollers (30), (31) and (32) may impose a rotation movement to the log (surface winding).

Once the desired log diameter (corresponding to a substantially defined web length or number of individual sheets) is reached, the continuous web (19) is cut. The produced log (34) is separated from the web (19) and subsequently the production of a new log begins.

The cutting unit (27) is arranged to cut the web according to regularly spaced cutting lines substantially transversally to the machine direction. The cutting of the web occurs at a transition phase, namely when a first log is finished at the end of a log production cycle, and before a second subsequent log starts being wound at the beginning of a new log production cycle.

The cutting lines (not shown) are lines in the axial direction made in the thickness of the web (19). Two consecutive cutting lines define the total web length forming one roll. The space between two consecutive cutting lines, i.e. the roll length, is determined depending on the target product. Typically, roll length and roll diameter are selected depending on e.g. the number of plies forming the web, the basis weight of the individual plies etc. An individual roll of absorbent sheet product can have a total web length in the machine direction of from 1 m to 60 m, from 1.5 m to 50 m, or from 2 m to 40 m.

The produced log (34) is then provided to the extraction module (33), which is arranged to extract the temporary cores (36) from the log (34) after the winding of a log is completed. The temporary cores (36) may be recycled after extraction towards the core supplier.

When the coating composition is an aqueous solution as described hereinabove, the produced log can be subjected to drying after the produced log is separated from the web of absorbent material and before extraction of the temporary core. The produced log can also be subjected to drying after extraction of the temporary core.

The produced log can be dried until the tissue paper forming the log contains an amount of water which does not exceed 10% of the total weight of the log, or 5% of the total weight of the log. For instance, the produced log can be dried by storing the log at room temperature (20° C. to 25° C.) and RH (relative humidity) of 10 to 60% for a period of 12 hours.

(D) Optionally severing the continuous web of absorbent material (19) substantially transversally to the machine direction to produce single but coherent sheets.

Figure 3:
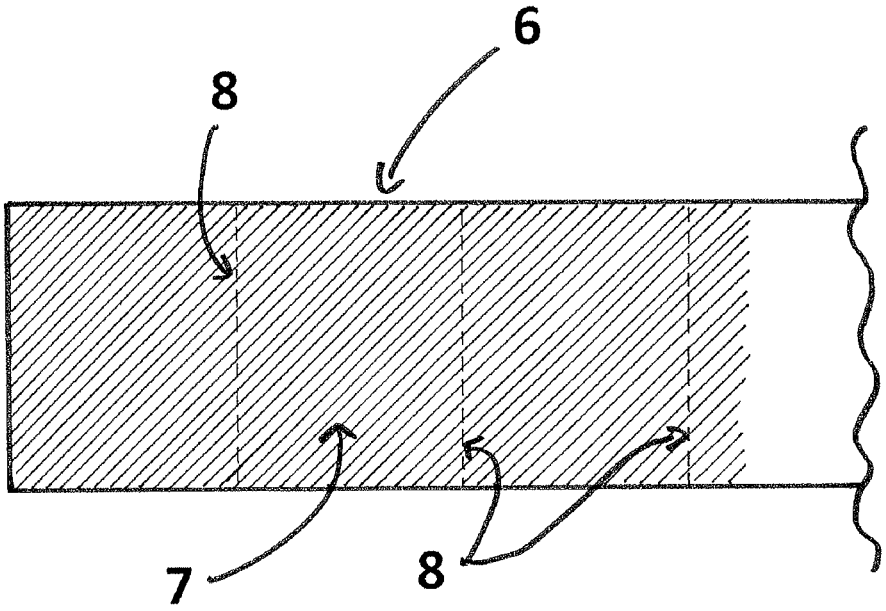
FIG. 3 is a schematic drawing of the second end of an unwound continuous web of absorbent material according to an embodiment of the present invention. The grey shading in FIG. 3 represents the coating composition which is applied continuously onto the second end.

Before the continuous web (19) is spirally wound by the winding module (29) as described above, the web (19) reaches the perforating module (26), if any, which is arranged to provide the web (19) with regularly spaced perforation lines (8) substantially transversally to the machine direction, i.e. in the axial direction, so as to produce single but coherent sheets (as shown in FIGS. 3, 4*a* and 4*b*).

A perforation line (8) is a line in the axial direction made in the thickness of the web (19) and includes alternating perforated segments and unperforated segments (i.e. two perforated segments being separated by one unperforated segment or vice-versa). Each unperforated segment forms an attachment area between two consecutive portions of the continuous web. Each perforated segment forms a detachment area between two consecutive portions of the continuous web. Considering the width of the individual roll, for example between 10 cm and 30 cm, the length of said unperforated/perforated segments can be from 1 mm to 15 mm, or from 4 mm to 10 mm. Other kinds of perforation lines are also possible as long as this is meaningful.

Two consecutive perforation lines (8) define the individual sheet length in the finished absorbent sheet product. The space between two consecutive perforation lines, i.e. the sheet length, is determined depending on the target product. A single sheet can have a length in the machine direction of from 80 mm to 300 mm. e.g. 100 mm to 250 mm. For example, a sheet of bathroom tissue can have a length of from 80 mm to 200 mm and a towel such as a household (kitchen) towel or hand towel can have a length of from 80 mm to 300 mm.

(E) Cutting the produced log (34) into multiple coreless rolls (1).

After winding, the log (34) is provided to the log cutting unit (14), in which the log (34) is cut parallel to the machine direction by multiple log saws (35) into multiple individual rolls (1). The multiple log saws (35) are regularly spaced in the axial direction such that the log (34) is cut into multiple individual rolls (1) having a determined width in the axial direction (i.e. distance from one edge to another edge). The width of an individual roll (1) is from 60 mm to 800 mm, from 70 mm to 400 mm, or from 80 mm to 150 mm.

A control module (37) is coupled to the perforating module (26), to the cutting module (27) and to the spraying or roll-coating system by an interface (38). The control module (37) controls the operation of the perforating module (26) and the cutting module (27). In particular, the control module (37) activates the cutting module (27) to sever the web (19) at a transition phase between two consecutive logs. Furthermore, the control module (37) controls the operation of the perforating module (26) out of transition phases.

In addition, the control module (37) controls the operation of the spraying or roll-coating system, namely the appropriate application (spraying or roll coating) of the coating composition onto the second end of the continuous web (19). The appropriate application of the coating composition onto the second end can be controlled by sending e.g. start/stop signals to the application (spraying or roll-coating) system, which are determined based on the length of the target product and the machine parameters, e.g. running speed.

Various rollers (17) are appropriately positioned in order to control the path of the continuous web (19) along the converting machine (9), within and between the various units.

(F) Optionally, subjecting the roll to compression in a direction perpendicular to the axial hollow passageway to produce a coreless roll in a compressed (oval) form (not shown).

The term "compression" herein refers to a pressure being applied on the roll in a direction perpendicular to the axial hollow passageway so as to produce a roll having an oval cross section, which requires less storage space. Roll compression can occur immediately after winding has been terminated. An appropriate device known in the art can be used to operate the compression. It is possible to use for example the two converging synchronically driven conveyor bands described in WO 95/13183, a pneumatic or hydraulic pressing plate, or other devices.

Thereafter, the individual coreless rolls (1) are packaged and prepared for shipping (not shown).

5. EXAMPLES

The following test methods were used to evaluate the absorbent materials, the polymers, and the coreless rolls produced.

5.1. Basis Weight

The basis weight was determined according to EN ISO 12625-6:2005, Tissue Paper and Tissue Products, Part 6: Determination of grammage.

5.2. Caliper

The measurement is made by a precision micrometer (precision 0.001 mm) according to a modified method based on EN ISO 12625-3:2014, Part 3. For this purpose, the distance created between a fixed reference plate and a parallel pressure foot is measured. The diameter of the pressure foot is 35.7±0.1 mm (10.0 $cm^2$ nominal area). The pressure applied is 2.0 kPa±0.1 kPa. The pressure foot is movable at a speed rate of 2.0±0.2 mm/s.

A usable apparatus is a thickness meter type L & W SE050 (available from Lorentzen & Wettre, Europe).

The tissue paper product to be measured cut into pieces of 20×25 cm and conditioned in an atmosphere of 23° C., 50% RH (Relative Humidity) for at least 12 hours.

For the measurement, one sheet is placed beneath the pressure plate which is then lowered. The thickness value for the sheet is then read off 5 seconds after the pressure has been stabilized. The thickness measurement is then repeated nine times with further samples treated in the same manner.

The mean value of the 10 values obtained is taken as thickness of one sheet ("one-sheet caliper") of the tissue paper product (e.g. a two-ply toilet paper) measured.

5.3. Glass Transition Temperature & Melting Point

The measurement is made by a Dynamic Mechanical Analyzer DMA 8000 equipped with a Material Pocket (available from PerkinElmer, Germany) and 1 L Dewar flask.

The polymer to be measured was added to the Material Pocket of the analyzer. The Material Pocket was mounted in the clamps (Single Cantilever Bending geometry) of the analyzer. The measurement was then run from −120° C. to 75° C., with a gradient of 3° C./min and at a frequency of 1.0 Hz.

The recorded tan δ response of the polymer is then plotted as a function of the temperature. The glass transition temperature and the melting point of the polymer are observed in the tan δ curve as peaks.

5.4. Number-Average Molecular Weight

The measurement is made by Gel Permeation Chromatography (GPC) using a PL-GPC 50 Integrated GPC/SEC System equipped with a PL aquagel-OH MIXED 8 μm column 7.5×300 mm (both available from Agilent Technologies, Europe). The GPC system was calibrated using a PEG-10 EasiVial calibration kit available from Agilent Technologies.

A sample of the polymer to be measured was dissolved in the eluent (water) at a concentration of 2 mg/mL. The sample was injected (injection volume: 100 μL) and run at a flow rate of 1.0 mL/min using water as the eluent. The retention time (min) of the polymer was recorded as a peak. The number-average molecular weight of the polymer was determined by comparing the recorded retention time with that of standard (calibration) polymers.

5.5. Resistance to Compression

The measurement is made by a vertical dynamometer equipped with a 1 kN cell. A usable apparatus is a dynamometer type ZwickiLine Z1.0 (available from Zwick Roell, Europe).

For the measurement, a roll is placed horizontally between the pressure plates, and pressure in applied is a direction perpendicular to the axial hollow passageway. The roll is compressed between the plates at a constant speed of 60 mm/min. The compression force is measured and plotted in function of the displacement of the cell. The compression force recorded at the first inflexion of the curve is taken as the resistance to compression of the roll. The resistance to compression measurement is repeated five times with further samples.

The mean value of the 5 values obtained is taken as resistance to compression of the roll measured.

5.6. Delamination Force

The measurement is made by a vertical dynamometer equipped with a shaft and an upper jaw. A usable apparatus is a dynamometer type ZwickiLine Z1.0 (available from Zwick Roell, Europe) equipped with a 10N cell.

For the measurement, the first inner turns of a coreless tissue paper roll is inserted on a shaft and the outermost paper sheet is inserted into the upper jaw. The turns are unwound at a constant speed of 60 mm/min. The delamination force needed for separating the paper sheets forming the turns is measured and plotted as a function of the displacement of the cell. The maximal force and the average force required to delaminate the sample are recorded within the displacement interval. The delamination force measurement is then repeated five times with further samples.

The mean value of the 5 values of the maximal force obtained is taken as the delamination force of the first inner turns.

5.7. Disintegrability

The disintegrability was determined according to NF Q34-20:1998, Sanitary and Domestic Articles—Bathroom Tissue—Determination of Disintegration.

5.8. Starting Materials, Chemicals and Converting Machine

Absorbent Material

A two-ply base tissue paper having a basis weight of 42 g/m$^2$ and a caliper of 0.41 mm (manufactured by SCA) was used as the continuous web of absorbent material in the following examples.

The two-ply base tissue paper (continuous web) was prepared with a conventional converting machine by combining a one-ply base tissue paper to the final ply count (2) as follows:

A first unwinding unit provided a first ply of base tissue from a first parent roll having a width of 0.6 m. A second unwinding unit provided a second ply of base tissue from a second parent roll having a width of 0.6 m. Both plies of base tissue were fed to an embossing unit. The base tissues were superposed and combined (associated) using an adhesive in the embossing unit in order to form a continuous web of absorbent material. The engraved cylinder performed a double-level engraving into the superposed absorbent log base webs. The adhesive used for ply bonding was Swift® tak 1004 in an amount of 0.5 g/m$^2$.

The resulting two-ply continuous web of absorbent material was fed to a rewinding unit.

Chemicals

The chemicals used in the following examples are listed below:

For the coating composition:

Polyethylene glycol "PEG3000" from Sigma-Aldrich with number-average molecular weight of about 3000 (as determined by GPC); the glass transition temperature was estimated to be approximately −22° C., and the melting point to be approximately 53° C. from available data for other molecular weights;

Polyethylene glycol "PEG6000" from Sigma-Aldrich with number-average molecular weight of about 6000 (as determined by GPC), glass transition temperature of −22.7° C., and melting point of 58.7° C. (as determined by DMA);

Starch Avedex W60 from Avebe;

Carboxymethyl cellulose (CMC) Blanose® 7M1C from Ashland;

Adhesives:

Swift® tak 1004 from H.B. Fuller (used for ply bonding);

Tissue Tak 604 from Henkel ("fugitive glue" used for winding).

Converting Machine

A conventional tissue paper converting machine was adapted to make a toilet paper having two plies. The machine involved two unwinding units, an embossing unit, a rewinding unit, and a log cutting unit.

The embossing unit comprised an engraved cylinder, a mating rubber cylinder and a glue dispenser. The engraved cylinder was engraved with a microstructure pattern combining various embossing tips. The glue dispenser comprised a vat, an applicator and a dipping cylinder.

The rewinding unit comprised a perforating module, a cutting module, a winding module and an extraction module. The perforating module comprised a perforator roll and a stationary anvil roll. The cutting module comprised a cutting roll and a stationary anvil roll.

The rewinding unit was furthermore equipped with a spraying system consisting of four spray guns type WA520 (available from Walther Pilot) having a nozzle diameter of 1.5 mm and working under an atomizing air pressure of 4 bars, a vat and pipes feeding the coating composition from the vat to the spray guns. The spraying system furthermore included a heating system, which maintained the coating composition in the vat, pipes and spray guns at a constant temperature of 60° C.

The spray guns were placed between the cutting module and the winding module such that the coating composition was sprayed on the lower side of the continuous web of absorbent material upstream to a cutting line at the beginning of the log, thus defining the first web end (i.e. the turns of the log/roll close to the axial hollow passageway).

The log cutting unit comprised multiple log saws.

Various rollers are appropriately positioned in order to control the path of the absorbent log base webs along the converting machine, within and between the various units. The absorbent log base webs travel into the converting machine according to the machine direction (MD) from the unwinding units, towards the embossing unit, towards the rewinding unit and towards the log cutting unit.

A control module was coupled to the perforating module, the cutting module and the spray guns by means of an interface. The control module controlled the operations of the perforating module and the cutting module, as well as the appropriate spraying of the coating composition onto the second end.

The machine speed was kept throughout the trials at 100 m/min.

Reference Example (Reference Toilet Paper)

To obtain the desired coreless roll of toilet paper, a two-ply continuous web of absorbent material was produced as described above, conveyed from the embossing unit and fed to the rewinding unit.

In the rewinding unit, the continuous web first reached the perforating module, which pinched the web to provide perforation lines transversally orientated relative to the machine direction (MD) and regularly spaced relative to the cross direction (CD). The size of the perforated segment was 4 mm and the size of the unperforated segment was 1 mm. The distance between two perforation lines was 123 mm.

After pinching, the web of absorbent material reached the winding module, in which the web was picked up onto a temporary core (external diameter: 38 mm) using Tissue Tak 604 as "fugitive adhesive". The web was then wound onto the core to form a log having a diameter of 101 mm (corresponding to a 150 perforated sheets).

The produced log was separated from the web of absorbent material by the cutting module, which severed the web transversally relative to the MD. The produced log was stored at 20-22° C., relative humidity of 50% for a period of 12 hours.

After storage, the temporary core was extracted from the log by the extraction module. The produced log was cut parallel to the MD by multiple log saws into multiple individual rolls having a width of 350 mm.

Example 1 (Toilet Paper with PEG3000)

A coating composition was prepared by dissolving polyethylene glycol having a number-average molecular weight of 3000 (PEG3000) in water at a concentration of 50% by weight. The obtained coating composition was fed to the spray guns and applied at room temperature.

To obtain the desired coreless roll of toilet paper, a coreless roll was produced in the same manner as described in the Reference Example above except that, after pinching/severing and before winding the web, the coating composition was applied (sprayed) by the spray guns onto a length of about 600 mm (i.e. about 5 sheets) upstream from the cutting line.

The amount of PEG3000 applied onto the second end (length: 600 mm) was 1.5 g/roll (the given amount corresponds to the amount of PEG3000 onto the 600 mm of one individual roll obtained after cutting the log)

Example 2 (Toilet Paper with PEG6000)

A coating composition was prepared by dissolving polyethylene glycol having a number-average molecular weight of 6000 (PEG6000) in water at a concentration of 33% by weight. The obtained coating composition was fed to the spray guns and applied at room temperature.

The coreless roll was produced in the same manner as Example 1 using the coating composition described above.

The amount of PEG6000 applied onto the second end (length: 600 mm) was 1.1 g/roll.

Comparative Example 1 (Toilet Paper with Starch)

A coating composition was prepared by dissolving starch (Avedex W60) in water at a concentration of 33% by weight. The obtained coating composition was fed to the spray guns and applied at room temperature.

The coreless roll was produced in the same manner as Example 1 using the coating composition described above.

The amount of starch applied onto the second end (length: 600 mm) was 1.0 g/roll.

Comparative Example 2 (Toilet Paper with Carboxymethyl Cellulose)

A coating composition was prepared by diluting CMC in water at a concentration of 3% by weight. The obtained coating composition was fed to the spray guns and applied at room temperature.

The coreless roll was produced in the same manner as Example 1 using the coating composition described above.

The amount of CMC applied onto the second end (length: 600 mm) was 0.1 g/roll.

The properties of the toilet paper rolls obtained in the Reference Example, Examples 1 and 2, and Comparative Examples 1 and 2 were evaluated according to the procedures explained hereinbefore. The results are shown in table 1 below.

TABLE 1

| Example | Resistance to compression (N) | Delamination force (N) | Perforation breakage and/or sheets damaged | Disintegration (s) |
|---|---|---|---|---|
| Ref. Example Untreated | 144 | 0.23 | No | 12.7 |
| Example 1 PEG3000-treated | 190 | 1.20 | No | 20.4 |
| Example 2 PEG6000-treated | 166 | 1.50 | No | 23.1 |
| Comp. Example 1 Starch-treated | 179 | 1.93 | Yes (5 out of 5) | 25.7 |
| Comp. Example 2 CMC-treated | 196 | 3.22 | Yes (5 out of 5) | 13.2 |

These test data show that the use of a coating composition according to embodiments of the present invention has led to an increased resistance to compression while the delamination force of the roll is in an acceptable range. A toilet paper with greater resistance to compression is also not prone to collapsing. Furthermore, the rolls according to embodiments of the present invention can be unwound up to the last sheet without tearing apart and/or damaging the sheets (i.e. no occurrence of perforation breakage and/or sheets damage in the delamination force measurement).

In contrast, the use of a coating composition containing starch or CMC provided a roll wherein the sheets of the first inner turns strongly adhere (glue) to each other. As a result, it was not possible to unwind the roll without tearing apart and/or damaging the last sheets.

The invention claimed is:

1. A coreless roll of an absorbent sheet product, comprising:

a spirally wound continuous web of absorbent material having a first end and a second end, the web of absorbent material being wound such as to define an axial hollow passageway centrally positioned relative to the coreless roll and extending from one edge to another edge of the coreless roll and such that the first end is located on the outer side of the roll and the second end is located at the axial hollow passageway; and a coating composition on the continuous web of absorbent material, the composition being free of saccharide and comprising a polymer having:

(i) a glass transition temperature lower than 20° C.; and (ii) a melting point greater than 20° C.

2. The coreless roll according to claim 1, wherein the coating composition is on the second end of the continuous web of absorbent material, and wherein the polymer has:

(i) a glass transition temperature lower than 0° C.; and (ii) a melting point greater than 35° C.

3. The coreless roll according to claim 1, wherein the coreless roll is obtained by applying the coating composition to the second end of the continuous web of absorbent material.

4. The coreless roll of claim 1, wherein the polymer is a polyether polyol.

5. The coreless roll of claim 4, wherein the polymer is polyethylene glycol having a number-average molecular weight of 800 to 250000.

6. A coreless roll of an absorbent sheet product, comprising:

a spirally wound continuous web of absorbent material having a first end and a second end, the web of absorbent material being wound such as to define an axial hollow passageway centrally positioned relative to the coreless roll and extending from one edge to another edge of the coreless roll and such that the first end is located on the outer side of the roll and the second end is located at the axial hollow passageway; and a coating composition being free of saccharide and comprising a polymer, wherein the polymer conforms to the following formula:

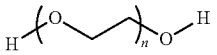

wherein, in the above formula, n represents an integer having an average value of 10 to 5000.

7. The coreless roll according to claim 4, wherein the coating composition is on the second end of the continuous web of absorbent material.

8. The coreless roll according to claim 4, wherein the coreless roll is obtained by applying the coating composition to the second end of the continuous web.

9. The coreless roll of claim 4, wherein the coating composition comprises:

(a) at least 50 wt.-% of the polymer;

(b) not more than 50 wt.-% of additives; and (c) not more than 10 wt.-% water;

each based on the total weight of the coating composition.

10. The coreless roll of claim 4, wherein the coating composition is applied in molten form or, after the addition of water, as an aqueous solution.

11. The coreless roll of claim 4, wherein the polymer has a number-average molecular weight of 800 to 250000.

12. The coreless roll of claim 4, wherein the axial hollow passageway has a circumference and the coating composition is circumferentially applied such that the resulting coating covers at least 10% of the second end.

13. The coreless roll of claim 4, wherein the coating composition is applied continuously in the machine and axial direction or intermittently in the machine and/or axial direction.

14. The coreless roll of claim 4, wherein the second end consists of at least one turn, a turn being one circumvolution of the spirally wound continuous web about the axial hollow passageway.

15. The coreless roll of claim 4, wherein the amount of polymer is from 0.1 to 20 g/roll.

16. The coreless roll of claim 4, wherein the web of absorbent material is composed of 1 tissue paper ply or 2 to 6 superposed tissue paper plies.

17. The coreless roll of claim 4, wherein the absorbent material is selected from the group consisting of napkins, towels, toilet papers, wipes, handkerchiefs, and facial tissues.

18. A manufacturing method for manufacturing a coreless roll of an absorbent sheet product, comprising:

conveying a continuous web of absorbent material having a first end and a second end;

applying a coating composition to the second end, wherein the coating composition is free of saccharide and comprises a polymer, wherein the polymer conforms to the following formula:

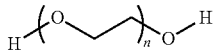

wherein, in the above formula, n represents an integer having an average value of 10 to 5000;

spirally winding the continuous web of absorbent material so as to produce a log of web of absorbent material, the web of absorbent material being wound such as to define an axial hollow passageway centrally positioned relative to the log and extending from one edge to another edge of the log and such that the first end is located on the outer side of the log and the second end is located at the axial hollow passageway; and cutting the log into multiple coreless rolls.

19. The manufacturing method of claim 18, further comprising:

subjecting the coreless roll to compression in a direction perpendicular to the axial hollow passageway to produce a coreless roll in a compressed form.

* * * * *